US008789923B2

(12) United States Patent
McNestry

(10) Patent No.: US 8,789,923 B2
(45) Date of Patent: Jul. 29, 2014

(54) PRINT HEAD WITH ELECTROMAGNETIC VALVE ASSEMBLY

(71) Applicant: Videojet Technologies Inc., Wood Dale, IL (US)

(72) Inventor: Martin McNestry, Heanor (GB)

(73) Assignee: Videojet Technologies Inc., Wood Dale, IL (US)

( * ) Notice: Subject to any disclaimer, the term of this patent is extended or adjusted under 35 U.S.C. 154(b) by 9 days.

(21) Appl. No.: 13/874,915

(22) Filed: May 1, 2013

(65) Prior Publication Data

US 2013/0242007 A1 Sep. 19, 2013

Related U.S. Application Data

(62) Division of application No. 12/959,846, filed on Dec. 3, 2010, now Pat. No. 8,454,126.

(51) Int. Cl.

| | |
|---|---|
| ***B41J 2/135*** | (2006.01) |
| ***B41J 2/175*** | (2006.01) |
| ***B41J 2/14*** | (2006.01) |
| *B41J 2/04* | (2006.01) |

(52) U.S. Cl.

CPC ..... *B41J 2/17596* (2013.01); *B41J 2202/05* (2013.01); *B41J 2/14* (2013.01); *B41J 2002/041* (2013.01)

USPC ..... 347/44

(58) Field of Classification Search

CPC ..... B41J 2202/05
USPC ..... 347/44
See application file for complete search history.

(56) References Cited

U.S. PATENT DOCUMENTS

| | | | | |
|---|---|---|---|---|
| 5,048,564 A * | 9/1991 | Gaiardo | ..... | 137/599.07 |
| 5,085,402 A * | 2/1992 | O'Dell | ..... | 251/129.21 |
| 5,090,441 A * | 2/1992 | Richmond | ..... | 137/242 |

* cited by examiner

*Primary Examiner* — Stephen Meier
*Assistant Examiner* — Alexander D Shenderov
(74) *Attorney, Agent, or Firm* — Joseph A. Yosick

(57) ABSTRACT

A print head includes an ink cavity, a nozzle in fluid communication with the ink cavity, and at least one valve assembly. The valve assembly includes a stopper positioned adjacent the nozzle and adapted to control flow of ink through the nozzle and an arm supporting the stopper. The arm is configured to pivotally move the stopper with respect to the nozzle to control the flow of ink through the nozzle. An electromagnet is positioned adjacent the arm and configured to move the arm toward the electromagnet to open the nozzle. A biasing member biases the arm away from the electromagnet to close the nozzle.

13 Claims, 11 Drawing Sheets

PRINT HEAD WITH ELECTROMAGNETIC VALVE ASSEMBLY

CROSS REFERENCE TO RELATED APPLICATIONS

This application is a Divisional of U.S. application Ser. No. 12/959,846, filed Dec. 3, 2010, the contents of which are incorporated herein by reference in its entirety.

BACKGROUND

The present disclosure relates to a print head having a plurality of nozzles, each nozzle independently capable of ejecting ink onto a substrate. In particular, the disclosure relates to a valve assembly for such a print head.

Drop-on-demand inkjet printers typically include a print head having an array of nozzles. During printing, ink is ejected through particular nozzles based on the nature of a character to be printed on a suitable medium. Ink is not ejected through every nozzle at all times during a printing process. Rather, only select nozzles are utilized at any one time depending on the nature of the character to be printed. Generally, drop-on-demand inkjet printers differ from continuous inkjet printers, in which a constant stream of drops are passed between charged electrodes, because ink is not ejected through all of the orifices during a particular printing process.

Drop-on-demand printers may be used to print information onto products moving along a packaging line. Typically the printer is stationary and it is necessary to ensure that the printer is controlled so as to print correctly onto the moving products. Drop-on-demand printers generally comprise a linear array of nozzles, each connected to an ink supply by a valve. By the operation of the valves, ink is projected from the nozzles to be used in printing. Typically, seven or 16 nozzles may be provided over a vertical distance of, for example, 2.7 inches. The vertical resolution provided by the array of valves is therefore relatively low.

The main cause of low resolution in valve jet printers is the physically large size of the solenoid used in the valves. To overcome this issue, it is known that the solenoids can be coupled to the nozzles by flexible tubes, so that the spacing of the nozzles can be smaller than the spacing of the valves. However, this is problematic in that the tubes may become clogged, especially when using quick drying ink. Various solutions to this problem have been used such as the design shown in U.S. Pat. No. 5,602,575, which couples a remote solenoid to the valve and nozzle by a wire. However, this solution requires a moving ink seal for the wire to pass through, and also each wire may need occasional adjustment, such as after shipping. Another potential solution is miniaturizing the solenoid, but this causes greater heating effect and adds cost.

BRIEF SUMMARY

The present disclosure provides a print head including a valve assembly which has improved resolution, minimizes the need for adjustment, can operate at high speed, can print aqueous or solvent based inks, and can be dismantled and refurbished if desired.

In one aspect, a print head includes a fluid cavity and nozzle in fluid communication with the fluid cavity. A stopper is positioned adjacent the nozzle and adapted to control flow of fluid through the nozzle. An arm supports the stopper and is configured to pivotally move the stopper with respect to the nozzle. An electromagnet is positioned adjacent the arm and configured to move the arm toward the electromagnet to open the nozzle.

In another aspect, a print head includes an ink cavity, a plurality of nozzles in fluid communication with the ink cavity, and a plurality of valve assemblies. Each valve assembly is individually adapted to control flow of ink between the ink cavity and the one of the plurality of nozzles. Each valve assembly includes a stopper positioned adjacent the nozzle and adapted to control flow of ink through the nozzle. A stopper gap is defined by the distance between the stopper and the nozzle when the stopper is in a maximum open position. An arm supports the stopper and is configured to pivotally move the stopper with respect to the nozzle to control the flow of ink through the nozzle. A center pole is positioned adjacent the arm and configured to move the arm toward the pole to open the nozzle. A pole gap is defined by the distance between the center pole and the arm when the stopper is in a closed position. The stopper gap can be greater than the pole gap.

In another aspect, an arm assembly for use with a nozzle of a print head includes a first end including a seating area for a stopper and a second end disposed opposite the first end. The arm assembly includes a generally elongated major portion disposed between the first and the second end and comprising a generally flat surface. The flat surface has a thickness less than 2 mm. A retainer including a plurality of extending fingers is crimped over the seating area of the arm to secure a stopper to the arm The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
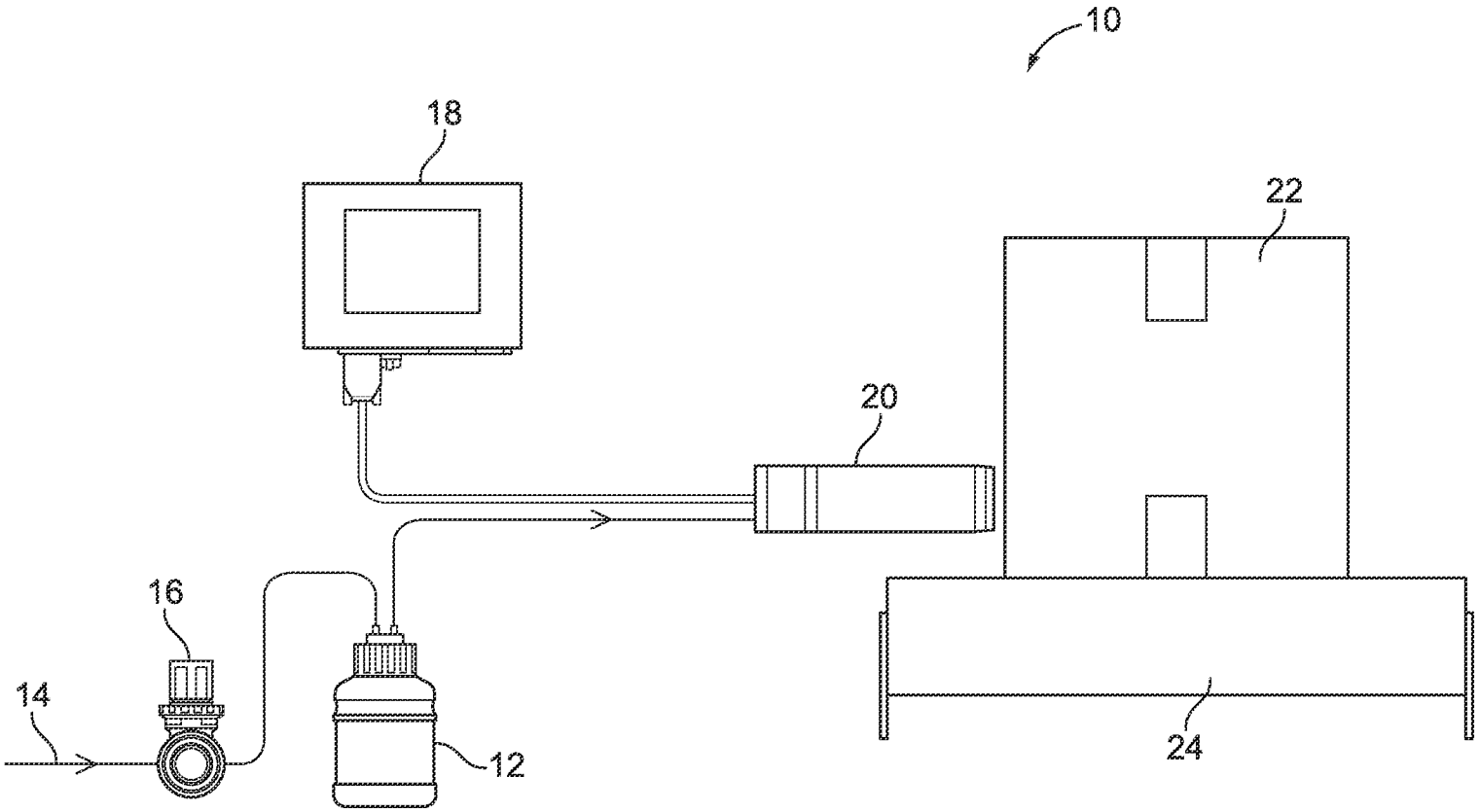
FIG. 1 is a schematic view of a printer system including an embodiment of a print head.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a print head including a valve assembly with a nozzle, a stopper positioned adjacent the nozzle and adapted to control flow of ink through the nozzle, and an arm supporting the stopper, where the arm is configured to pivot to move the stopper with respect to the nozzle to control the flow of ink through the nozzle. The disclosed valve assembly minimizes the need for adjustment, can operate at high speed, can print aqueous or solvent based inks, and can be dismantled and refurbished if desired.

FIG. 1 shows a schematic of an embodiment of a printer system 10. The system includes an ink source 12; a pressurized air supply 14; an air pressure regulator 16; a controller 18; and a print head assembly 20. The pressurized air supply 14 and air pressure regulator 16 may be used to pressurize the ink supplied to the print head assembly 20. The ink may be pressurized by other suitable means besides air pressure. A suitable pressure for an aqueous ink may be around 1-5 psi for an aqueous ink, preferably about 3 psi. A suitable pressure for a solvent based ink may be around 5-10 psi or 10-25 psi. The ink source 12 may provide any suitable ink composition for printing on a substrate. A wide variety of ink compositions may be used with the printer system 10, including aqueous or organic solvent based ink compositions. The controller 18, which may be provided on or with a computer, allows a user to input the desired print image or character and send instructions to the print head assembly 20 to print the desired images. The system 10 may be used to print variable coding information on substrate such as box 22, which may be positioned on a conveyor 24.

Figure 2:
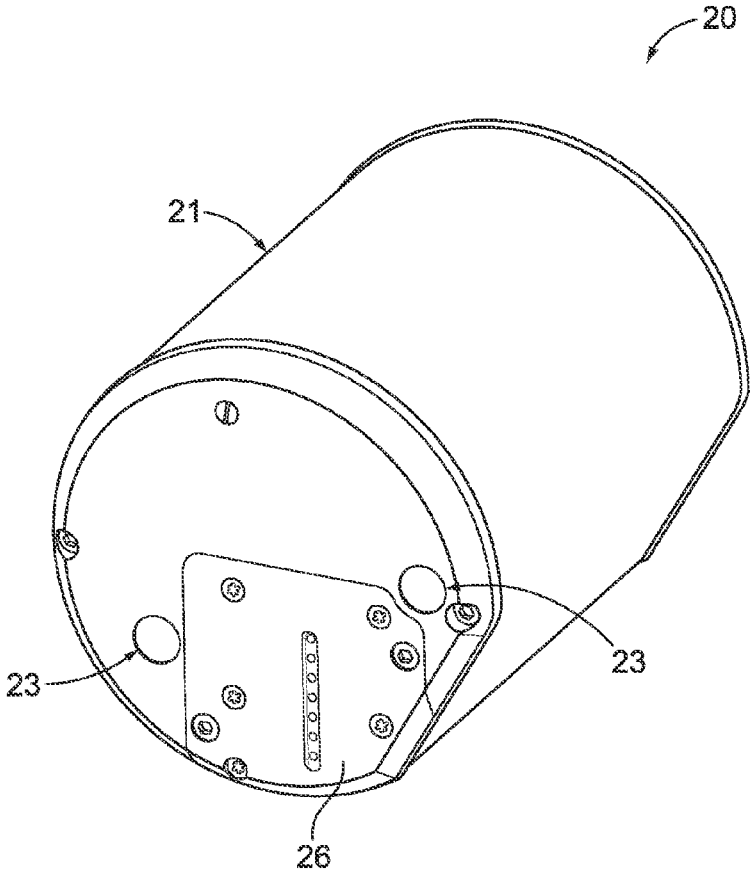
FIG. 2 is a perspective view of a print head assembly.
Figure 3A:
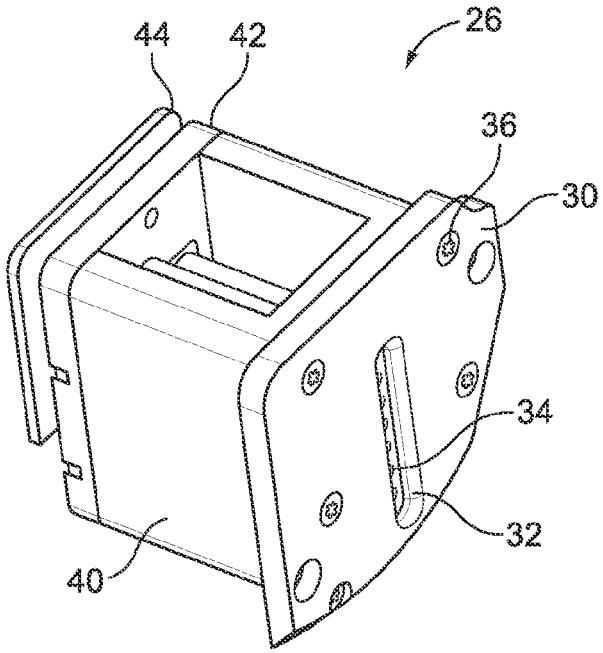
FIG. 3A is a perspective view of an embodiment of a print head.
Figure 3B:
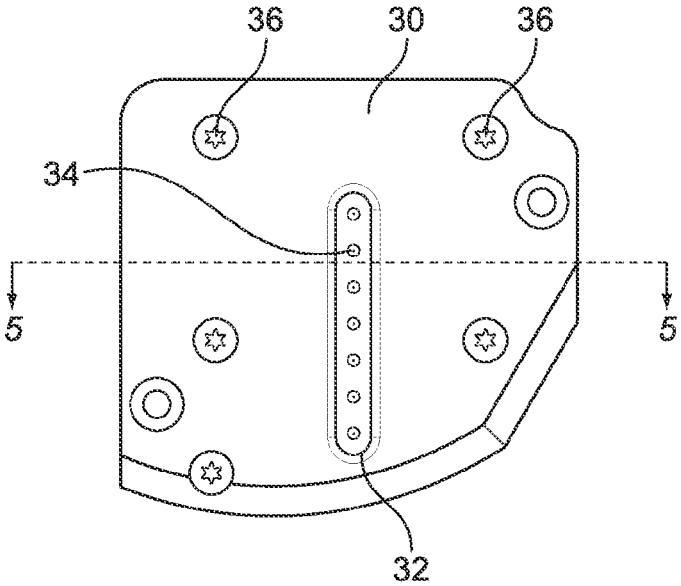
FIG. 3B is a view facing the nozzle plate of the print head of FIG. 3A.

FIG. 2 shows an embodiment of the print head assembly 20. The print head assembly 20 includes a housing or cover 21 disposed around the print head 26. The housing 21 serves to protect the components of the print head 26 from contact with e.g. packages, as well as contaminants such as dust and ink. The print head assembly 20 may include one or more sensors 23 to detect the presence of a package or other substrate to provide information to the controller 18 on when to send a print signal to the print head assembly 20.

FIGS. 3A, 3B, 4A, and 4B show an embodiment of a print head 26 removed from the housing 21. Print head 26 includes a nozzle plate 30 with a recess 32 disposed around a plurality of nozzle outlets 34 for ejecting ink. The number of nozzle outlets 34 may vary depending on the desired application. A typical number of nozzle outlets 34 is seven, as show in the depicted embodiment. A greater number of nozzle openings allows images with greater complexity or resolution to be printed. The nozzle outlets 34 are preferably disposed in a straight line, but other arrangements are possible. Each nozzle opening 34 is associated with a nozzle that is independently capable of ejecting a droplet of ink to collectively provide a code or image on a substrate. Nozzle plate 30 may be a generally planar structure and is preferably composed of a non-magnetic material. Preferred materials for the nozzle plate include stainless steel, including 304 stainless steel. Fasteners, such as bolts 36, attach nozzle plate 30 and back plate 42 to main pole 40. The nozzle plate 30 protects the nozzle themselves from being damaged by being hit by a box or other substrate; the nozzle outlets 34 are preferably recessed from the surface of the nozzle plate 30 through recess 32.

Main pole 40 is connected to the nozzle plate 30 and surrounds center poles 50, coils 60, and other components. A feature of the disclosed print head design 26 is that it uses a common main pole 40, rather than an individual main pole for each valve assembly. The use of a common main pole 40 keeps the size and the cost of the print head 26 down. The main pole 40 provides rigid mechanical support for components of the print head 26 such as the center pole and pivots (as described below), and an efficient path for magnetic flux in the operation of the valve assemblies.

Figure 4A:
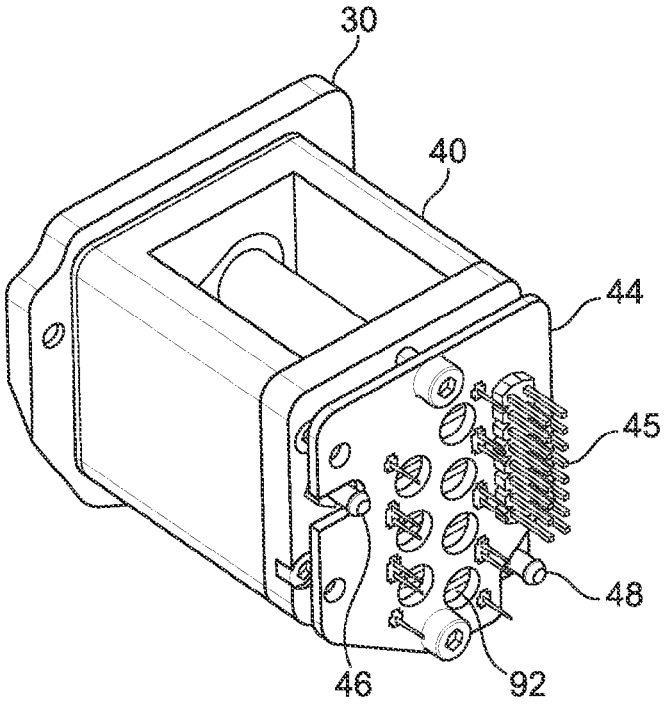
FIG. 4A is another perspective view of the print head of FIG. 3A.
Figure 4B:
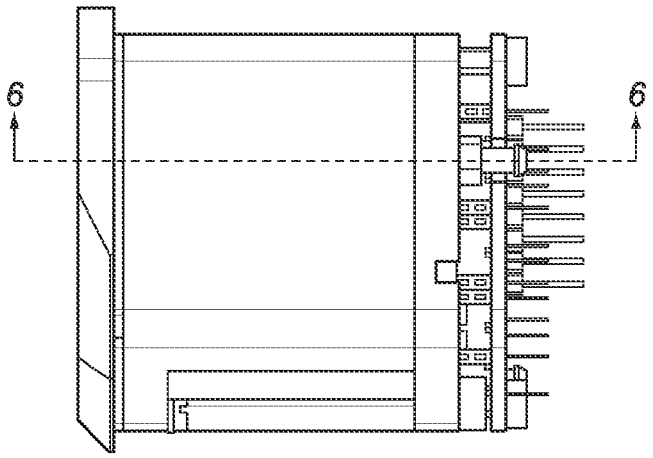
FIG. 4B is a side view of the print head of FIG. 3A.

The main pole 40 is preferably made of a soft magnetic material. Back plate 42 is generally planar in shape and is fixed adjacent to main pole 40. Back plate 42 provides an anchoring surface for various components, as will be described below. As best seen in FIGS. 4A and 4B, printed circuit board (PCB) 44 is disposed adjacent the back plate 42 and on the opposite side from the main pole 40. The PCB 44 provides electrical connections to the coils 60, and pins 45 to connect via a ribbon connector, for example, to controller 18. Ink inlet 48 provides ink for the reservoir inside the print head. Ink outlet 46 provides an outlet channel to remove air from the print head 26 during priming or flushing out of the print head 26.

Figure 5:
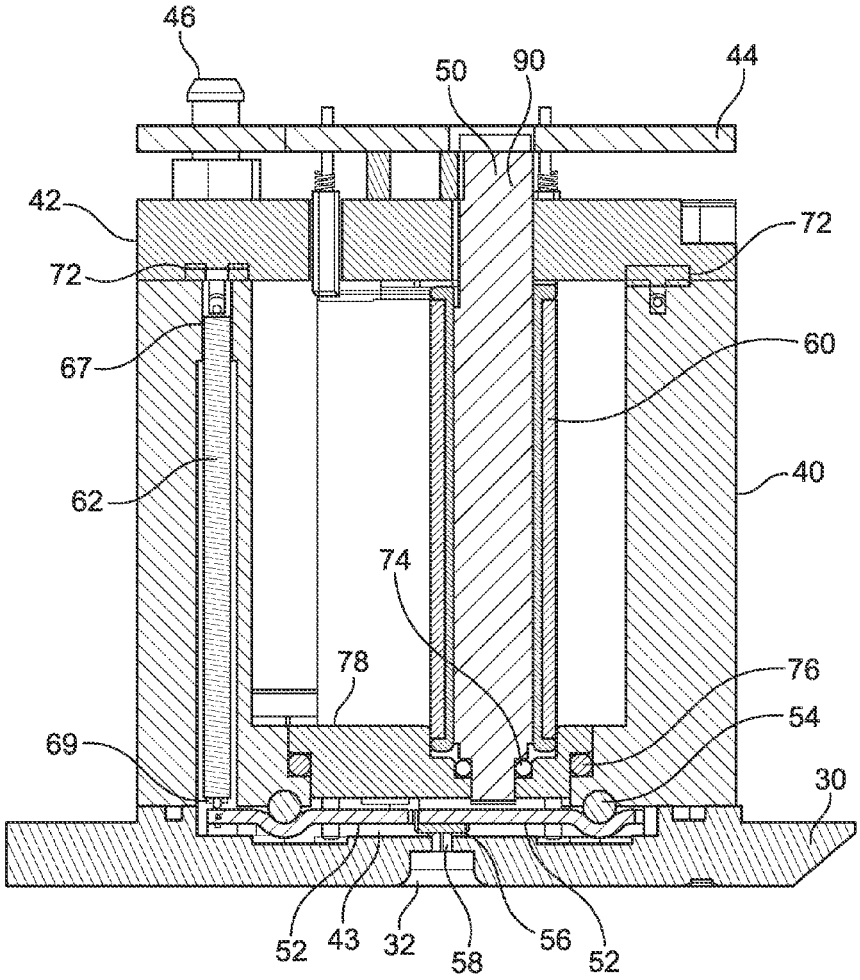
FIG. 5 is a sectional view along line 5-5 of FIG. 3B.
Figure 6:
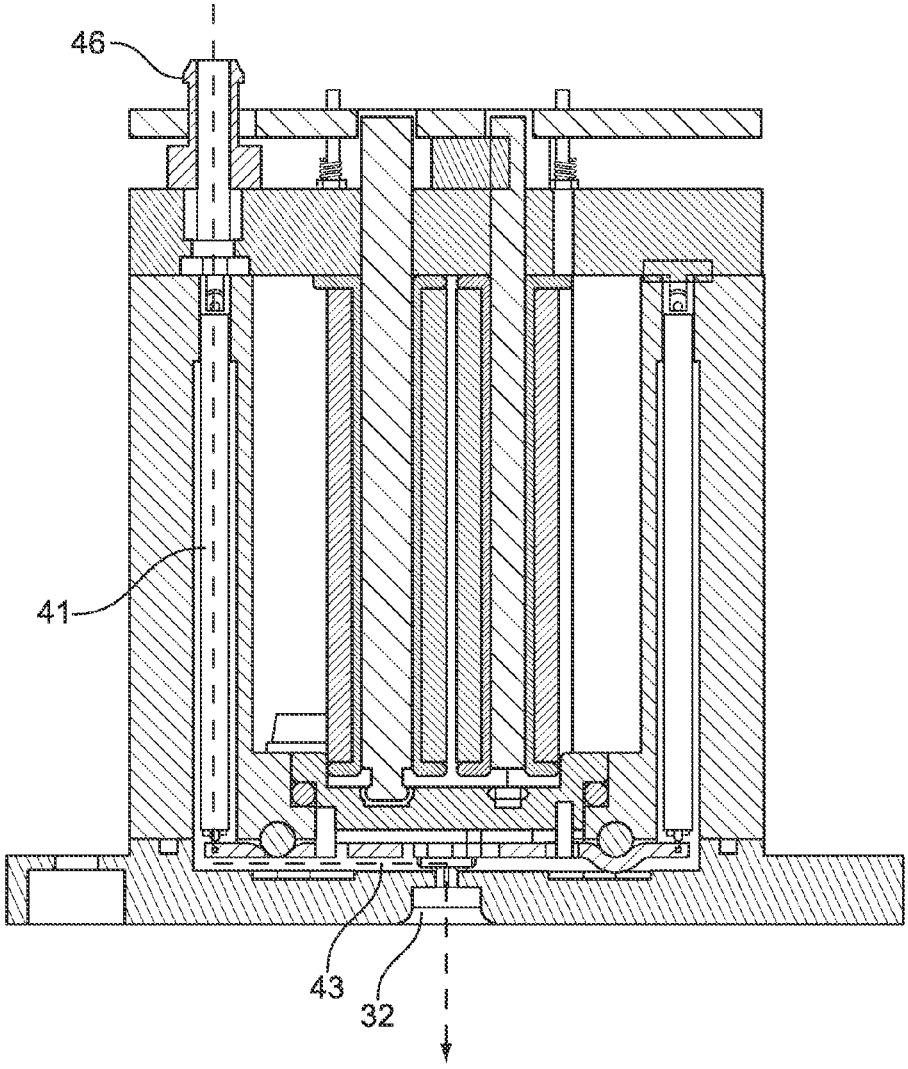
FIG. 6 is a sectional view along line 6-6 of FIG. 4B.
Figure 7A:
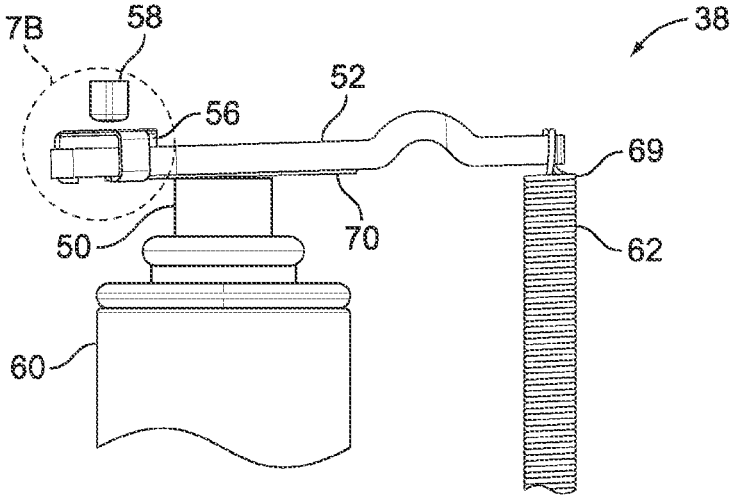
FIG. 7A is a schematic view showing an embodiment of a valve assembly in an open position.
Figure 7B:
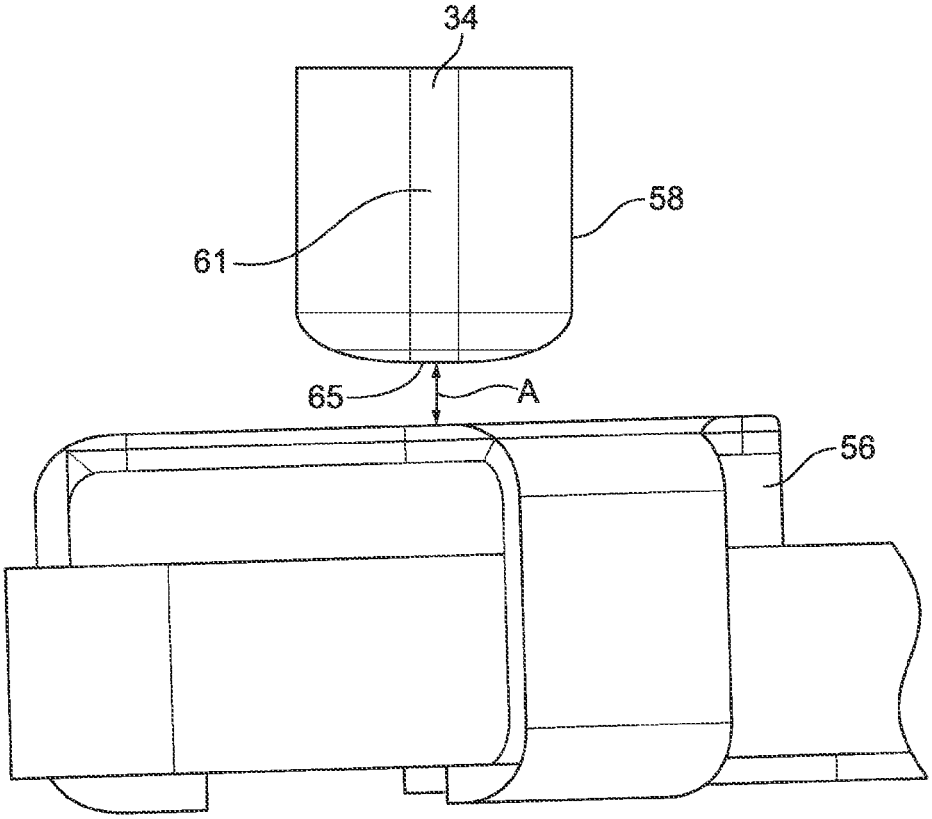
FIG. 7B is an enlarged view of the encircled area of FIG. 7A.

FIG. 5 is a sectional view of print head 26 to show the operation of a single valve assembly 38 within the print head 26. The assembly 38 includes electromagnet or center pole 50, arm 52, pivot 54, stopper 56, and nozzle 58. The nozzle 58 is in fluid communication with an ink reservoir 43 internal to the print head 26, and is disposed adjacent to opening 34. Nozzle 58 may be a separate component or combined in structure with nozzle plate 30. FIG. 6 illustrates the ink flow path. Ink enters the print head 26 via inlet 46 and travels via channel 41 (which may also contain spring 62) to reservoir 43 in fluid communication with nozzle 58 inside the print head 26. As shown in FIG. 7B, nozzle 58 includes a channel 61 with an outlet 34 and an inlet 65. The channel 61 may have a diameter of around 120 micron. The nozzle 58 may be made of sapphire. Recess 32 in nozzle plate 30 may be generally oval in shape with a flared portion toward the exterior of the nozzle plate 30. The stopper 56 is positioned adjacent the nozzle 58 and is adapted to control flow of ink between the ink cavity and the nozzle 58. In particular, when not printing, stopper 56 prevents flow through the channel 61 in the nozzle 58 by sealing the inlet 65 of the channel 61. Arm 52 supports stopper 56, and is configured to pivotally move the stopper 56 with respect to the nozzle 58 to control the flow of ink through the nozzle 58. The electromagnet or center pole 50 is positioned adjacent the arm 52 and configured to move the arm 52 toward the center pole 50 to open the nozzle to allow fluid flow therethrough. The center pole 50 functions by providing a magnetic attraction force to arm 52 to move it toward center pole 50 when magnetized. The center pole 50 is preferably made of a soft magnetic material, such as stainless steel, particularly 430 FR stainless steel.

A biasing member or spring 62 urges the arm 52 away from the electromagnet 50 to close the nozzle 58 when no magnetic field is present in center pole 50. The spring 62 is anchored at a first end 67 to a portion of the back plate 42 and at a second end 69 to the arm 52. Besides extension spring 62, other forms of biasing members may be used with the valve assembly 38, such as leaf springs, torsion springs, a magnetic force, an elastomer spring, and the like.

Figure 11:
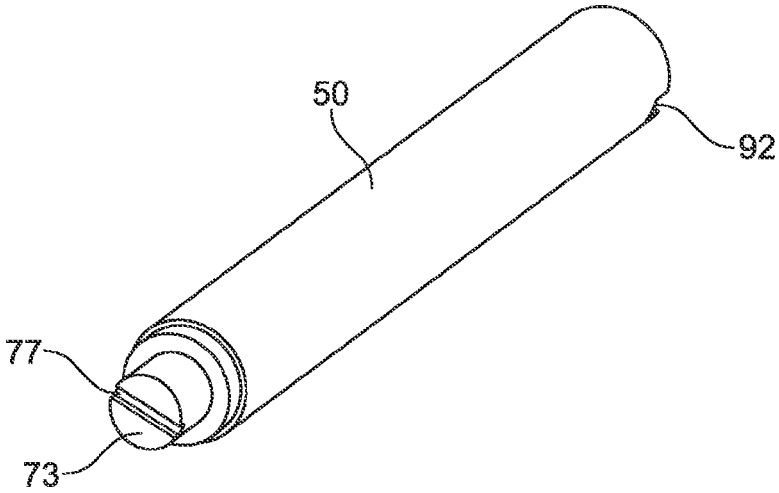
FIG. 11 is a perspective view of a center pole.

The center pole 50 provides a magnetic force to attract the arm 52 towards tip 73 of center pole 50. Surrounding the center pole is a coil 60. By passing current through coil 60, a magnetic field is generated which magnetizes the soft magnetic material of center pole 50. The diameter of the center poles 50 may be around 3 mm at the tip 73 adjacent the pole gap. As shown in FIG. 11, end 73 of center pole 50 may have a slot 77 disposed therein to prevent viscous damping in the operation of the valve assemblies 38.

Seals may be used between the various components to prevent leakage of the ink or other fluids at interfaces. As shown in FIG. 5, two gaskets 72 are disposed between the main pole 40 and back plate 42. O-ring seals 74 are disposed between the end of each center pole 50 and the seal plate 78. O-ring 76 is disposed between the seal plate 78 and the main pole 40. In this embodiment, the valve assemblies 38 in the print head 26 do not use any moving seals, only the fixed seals such as o-ring seals 72, 74, and 76.

As illustrated in FIG. 7B, a stopper gap A is defined by the distance between the stopper 56 and the nozzle 58 when the valve assembly 38 is in a maximum open position. The pole gap B is defined by the maximum distance between the electromagnet 50 and the arm 52 when the valve assembly 38 is in a closed position, as shown on FIG. 8B. Alternatively, the stopper gap A may be defined as the distance the stopper 56 moves between the open and closed position, and pole gap B may be defined as the distance the arm 52 moves with respect to the electromagnet 50 between the open and closed positions. In conventionally designed valves, the moving armature of the valve is a cylindrical metal part that moves linearly along its axis, so that the whole of the armature moves the whole of the valve gap and the stopper is attached to the armature; thus, the pole gap is always the same as the stopper gap, in contrast to the present embodiment.

Figure 8A:
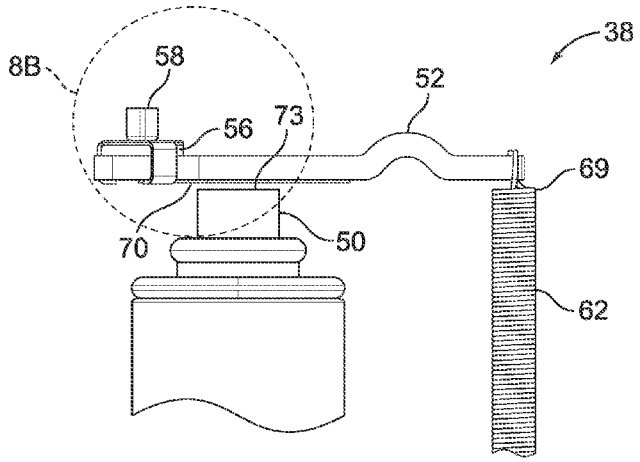
FIG. 8A is a schematic view showing an embodiment of a valve assembly in a closed position.
Figure 8B:
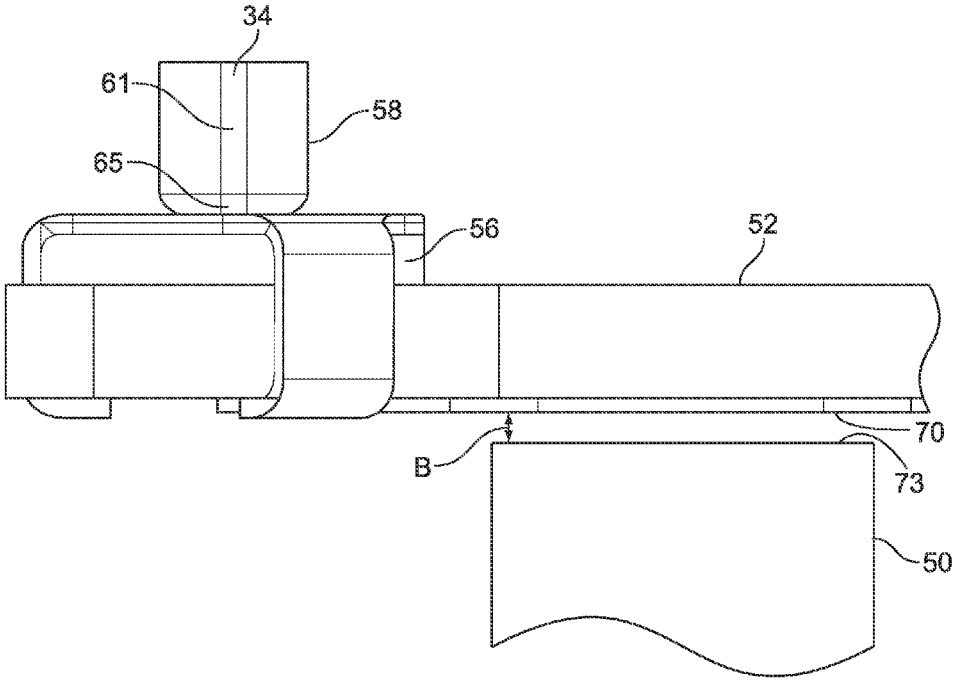
FIG. 8B is an enlarged view of the encircled area of FIG. 8A.

In the design depicted in FIGS. 7B and 8B, only the stopper 56 moves the whole stopper gap distance A; the portion of the arm 52 adjacent the end 73 of the center pole 50 moves a smaller distance B. The closer a given point on the arm 52 is to the pivot 54, the smaller the linear distance moved by the point on the arm 52. In designing a configuration for the valve assembly 38, the position of the end 73 of the center pole 50 in relation to the pivot 54 controls the pole gap B. Thus, the valve design of the print head 26 allows the stopper gap A and the pole gap B to be different. A feature of the nozzle design depicted in FIGS. 7A and 8A is that the pivoting action of the stopper 56 and the arm 52 means that the stopper movement A is larger than the magnetic pole gap B. This is beneficial because the magnetic force generated by the solenoid on the rocker is proportional to 1/(pole gap squared). Thus, for example, if the pole gap is halved, the magnetic force is theoretically quadrupled. The valve assembly 38 provides the arm 52 with pivoting rather than sliding action, which reduces the apparent inertia of the moving part of the valve assembly 38.

Thus, in one embodiment, the stopper gap A is greater than the pole gap B. In an embodiment, ratio between the stopper gap A and the pole gap B is between 1.1 and 2.5, preferably between 1.1 and 2.0. In an embodiment, the stopper gap A is between 50 μm and 100 μm, preferably between 70 μm and 80 μm, most preferably around 75 μm. In an embodiment, the pole gap B is between 25 μm and 75 μm, preferably between 35 μm and 65 μm, most preferably around 50 μm. In another embodiment, the stopper gap A is smaller than the pole gap B. Such an embodiment could be achieved by positioning the stopper closer to the pivot than the position of the center pole 50. In another embodiment, the stopper gap A is generally equal to the pole gap B, although this may increase the spacing of the nozzles 58.

Figure 9:
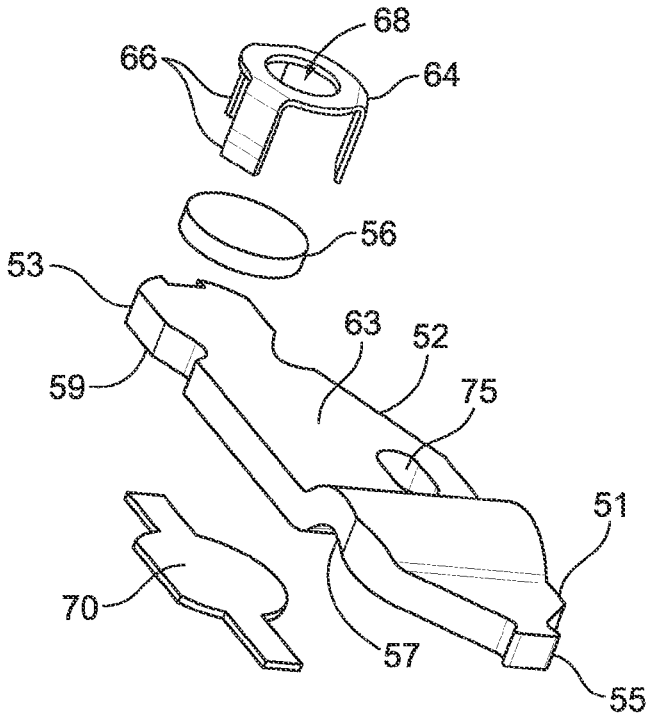
FIG. 9 is an exploded view of the components of an embodiment of an arm assembly of the print head of FIG. 3A.
Figure 10:
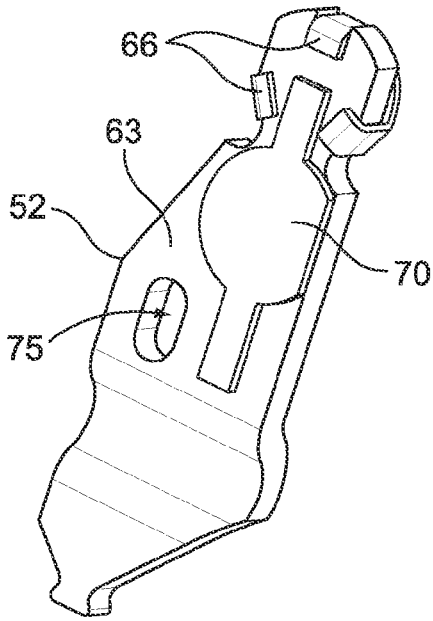
FIG. 10 is a view of the embodiment of an arm assembly of FIG. 9.

An embodiment of a design of the arm 52 is shown in FIGS. 9 and 10. The arm 52 is generally elongated in shape with a first end 51 configured to be attached to the spring 62 and a second end 53 configured to hold stopper 56. The arm 52 includes a generally elongated major portion 63 with a generally flat surface. The arm 52 is relatively thin compared to its length and width. In one embodiment, the thickness of portion 63 of the arm 52 is less than 2.0 mm, preferably less than 1.0 mm First end 51 may include anchor portion 55. Second end may include a head or seating area 59 which is generally shaped to correspond to a retainer 64 and allow attachment thereto. Disposed on a middle portion of the arm 52 is a semi-circular curved surface 57 oriented transverse to the elongated direction of arm 52. Surface 57 is configured to abut the curved surface of pivot 54 and allow the arm 52 to move pivotally relative to the pivot 54. The curved surface 57 of the arm 52 is of a slightly larger radius than the curved surface of the pivot 54 so that the arm 52 moves relatively friction free, since the arm 52 moves with a rolling action rather than a rubbing action. The arm 52 may be made from pressed steel, which allows for low mass and provides a large surface area at the pole gap, as well as being inexpensive compared to turned armatures.

Stopper 56 may be attached to arm 52 with retainer 64. Retainer 64 includes fingers 66 configured to crimp around a portion of arm 52, particularly head 59. Retainer 64 also includes an opening 68 to allow for direct contact of stopper 56 against the inlet 65 in nozzle 58. Retainer 64 may be a separate piece, or may be integrally formed with arm 52. The stopper 56 is preferably generally disc-shaped. The stopper 56 is preferably made of a solvent-resistant material such as a fluoroelastomer such as Chemraz. Because the fingers 66 of retainer 64 clamp the stopper 56 in the plane of valve movement, the clamping tends to pre-compress the stopper 56 which helps the material of the stopper 56 resist stretching. In one embodiment, the dimensions of stopper 56 are about 3 mm in diameter and 0.5 mm in thickness.

The arm 52 is composed of a magnetic material. In one embodiment, as shown in FIGS. 9 and 10, a shim 70 made of a non-magnetic material is disposed or affixed on the surface of arm 52 on elongated major portion 63 between the arm 52 and the center pole 50 to provide a minimum magnetic gap between the arm 52 and the end 73 of the center pole 50 when the valve assembly 38 is in the open position, as shown in FIG. 7A. The non magnetic shim 70 on the back of the arm 52 helps the valve assembly 38 to operate at higher speeds, allowing the print head 26 to close more quickly, hence providing more drops per second. Without intending to be bound by theory, it is believed that without the shim 70, when the valve is open and the pole gap is zero, the attractive force on the arm is at its highest value, and when the coil 60 is de-energized to close the valve assembly 38, it takes significant time for the magnetic flux in the center pole 50 to decay sufficiently to allow the valve assembly 38 to close. With the shim 70 in place, the magnetic pole gap never goes to zero, so the maximum magnetic attraction force is lower, thus allowing the valve assembly to close more quickly. Arm 52 may include a slot or hole 75 which aids in positioning of the arm with respect to the rest of the print head 26, as described below.

Figure 12:
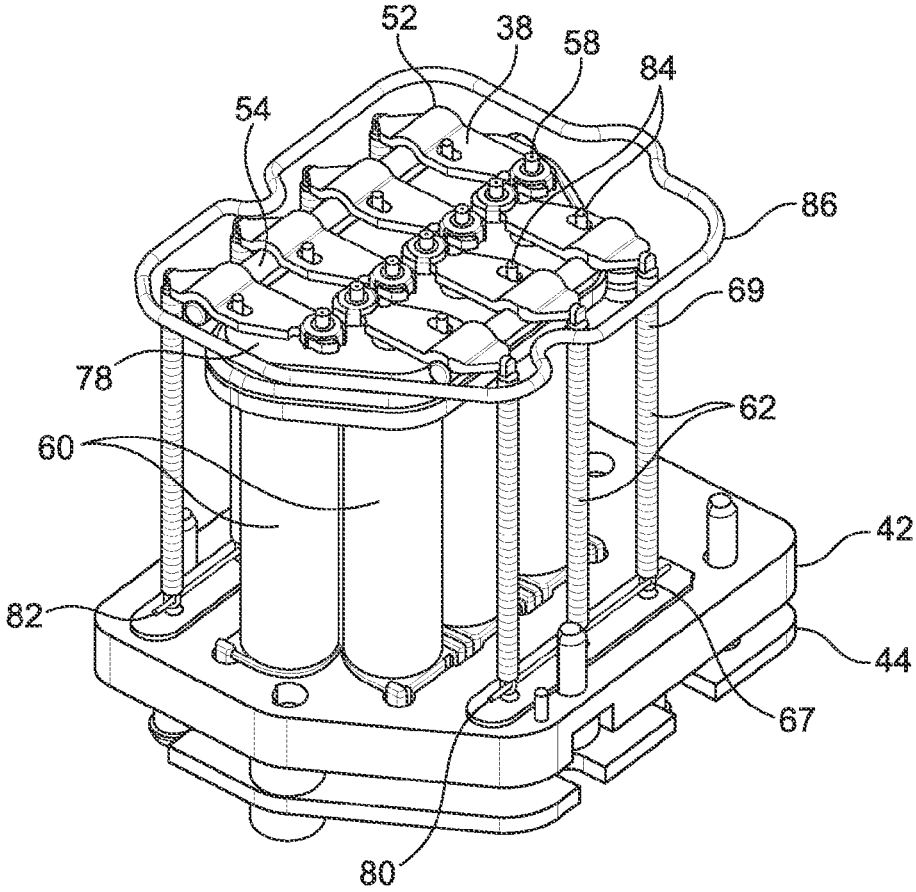
FIG. 12 is a perspective view showing inner components of the print head of FIG. 3A.

FIG. 12 shows a partial view of the print head 26 with the nozzle plate 30 and main pole 40 removed for clarity. The print head 26 includes seven nozzles 58 in fluid communication with an ink cavity. Each nozzle 58 is part of a valve assembly 38. Three valve assemblies 38 are located on one side of the line of nozzles 58, and four valve assemblies 38 are located the opposite side of the line of nozzles 58. Bars or wires 80 and 82 are disposed adjacent the back plate 42 to provide an anchor point for the ends 67 of springs 62. Posts 84 extend from the seal plate 78 through arm opening 75 to position the arm 52 properly. A seal 86 is disposed between the nozzle plate 30 and main pole 40 (neither shown in FIG. 12). Each valve assembly 38 is individually adapted to control flow of ink between the ink cavity 43 and the one of the plurality of nozzles 58. In one embodiment, seven nozzles are each positioned about 4 mm apart to provide a print height of approximately 25 mm. The line of nozzles 58 may be positioned at a variety of orientations with respect to the substrate. For example, the line of nozzles 58 may be oriented generally vertically to provide the maximum print height at lower speeds. Alternatively, the line of nozzles 58 may be oriented at an angle with respect to the travel direction of the substrate, to provide for smaller print height. It will be appreciated that when the line of nozzles 58 is angled, the timing of the opening and the closing of the nozzles will have to be adjusted so that the angled print line produces vertical characters on the substrate.

As best seen in FIGS. 4A and 5, in one embodiment each center pole 50 is threadedly attached to a portion of the print head 26, such as the back plate 42, so that the pole gap B is adjustable by rotating the center pole 50 with respect to the print head 26. A first end 90 of center pole 50 may include a slot 92 to facilitate such rotation, allowing the center poles 50 to be rotated with a tool such as a screwdriver. Since the pole gap B may be easily adjusted, the manufacturing tolerances on various components parts of the print head 26 can be relaxed, thus making manufacturing simpler and saving cost. As shown in FIGS. 4A and 12, the center poles 50 may be arranged in a staggered fashion such that the center poles 50 of adjacent nozzles 58 are disposed on opposite sides of the line of nozzles.

An advantage of the disclosed print head 26 is that it may be used with a variety of fluids, by ensuring material compatibility with any fluid that can be jetted. In one embodiment, the ink is an aqueous ink. In another embodiment, the ink is an organic solvent based ink. Non-limiting examples of organic solvents include ketones (such as acetone and methyl ethyl ketone); alcohols (such as methanol and ethanol); ethers; and esters. Other ink compositions may be oil-based (e.g. mineral oil).

Turning now to the operation of the print head 26, each nozzle 58 is opened by passing current through coil 60, which magnetizes center pole 50 to attract arm 52 to the end 73 of center pole 50, thus moving stopper 56 away from the inlet 65 in nozzle 58. Thus, one or more of the center poles 50 is selectively magnetized to open an associated nozzle 58 to eject ink from the nozzle onto a substrate to form an image on the substrate. To close the associated nozzle 58, the one or more of the center poles is demagnetized by stopping current flow through the coil 60, thus allowing the spring 62 to pull the arm 52 back to a closed position. In one embodiment, a reverse current is briefly (by way of example, in the range of 50 μs to 500 μs) run through the coil 60 during the closure process, which speeds up the closure of the valve assembly 38 to help the valve assembly 38 to operate at higher speeds. In one embodiment, the valve operates at a speed of greater than 1000 dots per second.

Figure 13A:
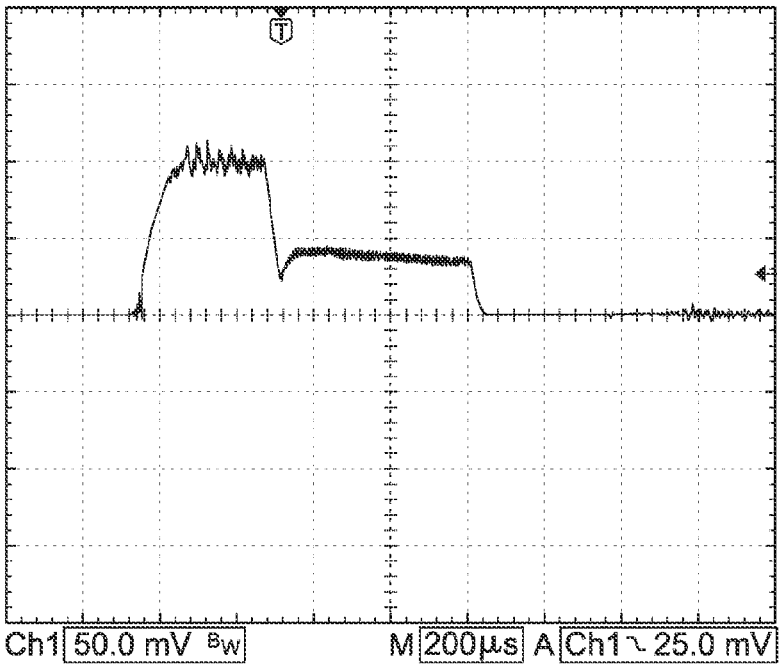
FIG. 13A is an embodiment of a current versus time trace for a valve.
Figure 13B:
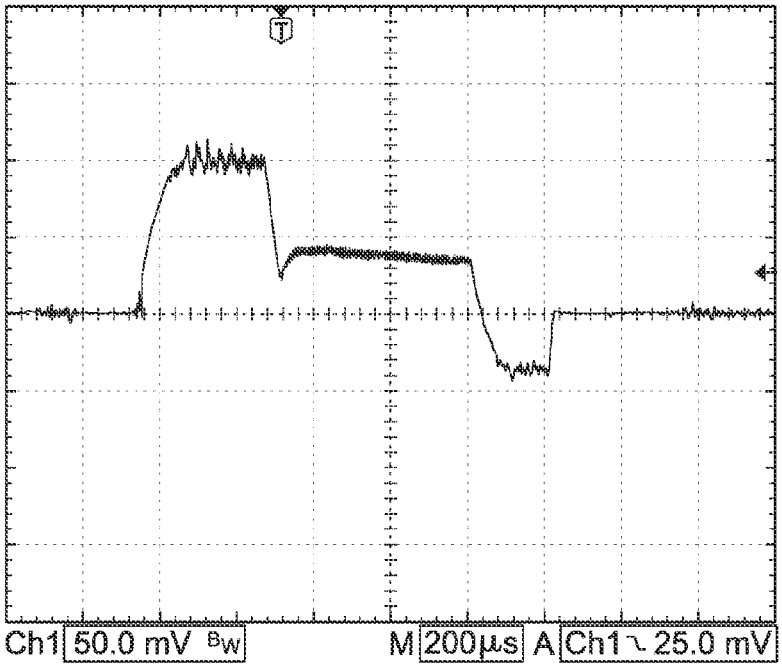
FIG. 13B is another embodiment of a current versus time trace for a valve.

Two embodiments of specific current traces that may be used for opening and closing the valves are shown in FIGS. 13A and 13B. In FIG. 13A, the current for the first (left) peak is about 1 amp, and the current for the second peak is about 0.35 amp. In this embodiment, the current is reduced from 1 amp to 0.35 amp after a short time, because once the valve has fully opened, it takes much less current to keep it open, so reducing the current saves on the amount of power used. If it is desired to increase time the valve is open, the length of time for the second 0.35 amp portion may be increased. The current trace in FIG. 13B is generally the same as that of FIG. 13A except that it includes a current of −0.3 amp for the reverse current portion. The time base is 200 microseconds per division (between the dotted lines) so that the whole valve drive waveform in FIG. 13B takes about 1.1 miliseconds.

Many existing printers have print head assemblies which include components held together with epoxy or other adhesives, or welded, and thus cannot be easily disassembled in the event of failure either in the field or during manufacture. The present disclosure provides a print head where substantially every part could be removed and replaced so that the print heads could be refurbished and reused. Additionally, the design does not require the use of tubes between the valves and the nozzles, reducing the tendency of the device to clog.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A print head comprising:

a ink cavity comprising ink;

a nozzle in fluid communication with the ink cavity; and at least one valve assembly comprising:

a stopper positioned adjacent the nozzle and adapted to control flow of ink through the nozzle;

an arm supporting the stopper, the arm configured to pivotally move the stopper with respect to the nozzle to control the flow of ink through the nozzle;

a curved pivot surface, wherein the arm comprises a portion with a semi-circular surface configured to abut the curved surface and pivotally move the arm relative thereto;

an electromagnet positioned adjacent the arm and configured to move the arm toward the electromagnet to open the nozzle; and a biasing member to bias the arm away from the electromagnet to close the nozzle.

2. The print head of claim 1 wherein a stopper gap is defined by the distance between the stopper and the nozzle when the stopper is in a maximum open position and a pole gap is defined by the distance between the electromagnet and the arm when the stopper is in a closed position, wherein the stopper gap is greater than the pole gap.

3. The print head of claim 2 wherein the ratio between the stopper gap and the pole gap is between 1.1 and 2.0.

4. The print head of claim 2 wherein the stopper gap is between 50 μm and 100 μm and the pole gap is between 25 μm and 75 μm.

5. The print head of claim 1 wherein a stopper gap is defined by the distance between the stopper and the nozzle when the stopper is in a maximum open position and a pole gap is defined by the distance between the electromagnet and the arm when the stopper is in a closed position, wherein the stopper gap is generally equal to the pole gap.

6. The print head of claim 1 wherein a stopper gap is defined by the distance between the stopper and the nozzle when the stopper is in a maximum open position and a pole gap is defined by the distance between the electromagnet and the arm when the stopper is in a closed position, wherein the stopper gap is smaller than the pole gap.

7. The print head of claim 1 wherein the arm comprises a generally elongated major portion comprising a flat surface.

8. The print head of claim 1 wherein the stopper is generally disc-shaped and the arm comprises a plurality of members crimped over the stopper to secure it to the arm.

9. The print head of claim 1 wherein the arm comprises a magnetic material, further comprising a non-magnetic shim disposed between the arm and the electromagnet to provide a minimum magnetic gap between the arm and the electromagnet when the stopper is in the open position.

10. The print head of claim 1 further comprising a return spring associated with the arm to urge the stopper to a closed position.

11. The print head of claim 1 wherein the ink is an aqueous ink.

12. The print head of claim 1 wherein the ink is an organic solvent based ink.

13. The method of claim 1 wherein the ink is pressurized at a pressure of at least 1 psi.

* * * * *